United States Patent [19]

Anderson

[11] Patent Number: 4,965,988

[45] Date of Patent: Oct. 30, 1990

[54] SADDLE TREE

[76] Inventor: Derrick A. Anderson, 1209 Braxton Ct., North Wales, Pa. 19454

[21] Appl. No.: 307,062

[22] Filed: Feb. 7, 1989

[51] Int. Cl.[5] ..... B68C 1/02

[52] U.S. Cl. ..... 54/44

[58] Field of Search ..... 54/44, 46

[56] References Cited

U.S. PATENT DOCUMENTS

| | | | |
|---|---|---|---|
| D. 228,770 | 10/1973 | Adeney | 54/44 X |
| 3,835,621 | 9/1974 | Gorenschek | 54/44 |
| 4,265,075 | 5/1981 | Motsenbocker | 54/44 |
| 4,287,705 | 9/1981 | Frost et al. | 54/44 |
| 4,771,590 | 9/1988 | Bates | 54/44 |

*Primary Examiner*—Robert P. Swiatek

*Attorney, Agent, or Firm*—Joseph W. Molasky & Assocs.

[57] ABSTRACT

A tree configuration for use in combination with an exercise or racing saddle. The tree is formed by injection molding with a thermoplastic material that results in a flexible, durable, symmetrical and smooth surface entity. The flexibility of the material prevents undue stressing of the tree at points where certain extended members are attached to the main body and, the members return to their original state after usage without maintaining a permanent spread or set. The smoothness and memory characteristic of the material result in minimal damage to the leather portion of the saddle.

16 Claims, 5 Drawing Sheets

FIG. 8
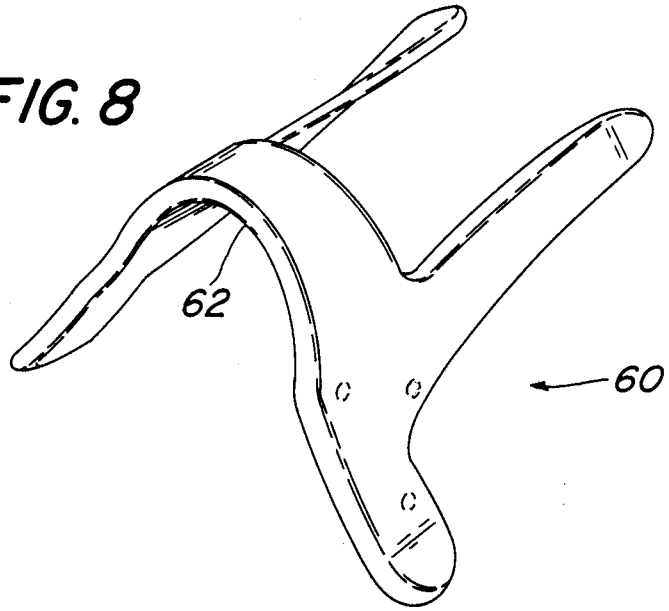
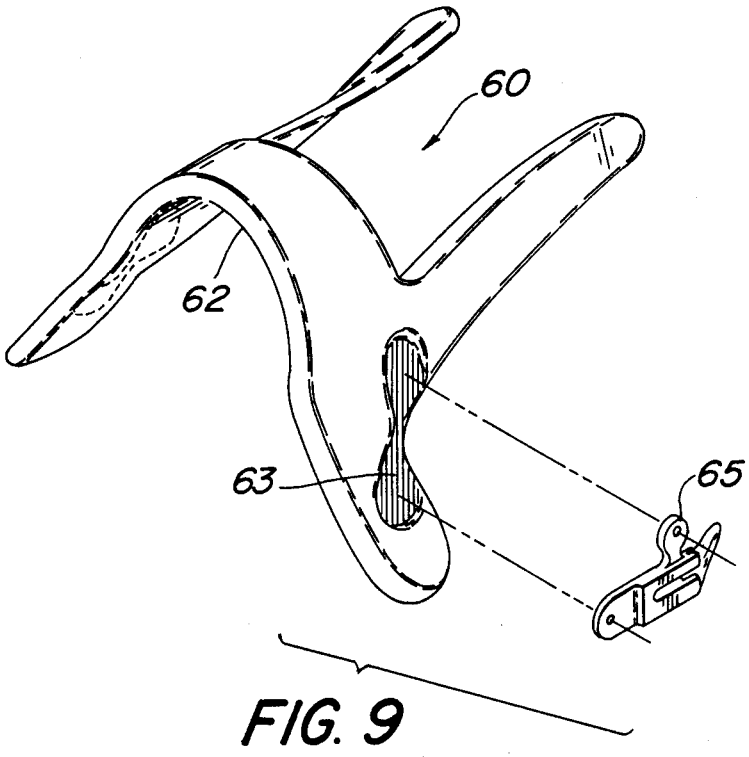
FIG. 9

SADDLE TREE

BACKGROUND OF THE INVENTION

This invention relates to a riding saddle and in particular relates to the design and fabrication of trees for integral use with the saddle.

DESCRIPTION OF THE PRIOR ART

The field of prior art tree design for use with various riding saddles has been characterized by poor durability such that the leather portion often outlasts conventionally made wood or metal trees. The relatively short life span of the prior art trees is caused by stress upon certain of its flexible members when positioned upon a four-legged animal such as a horse. Eventually the stress at the flexure points causes a fracture to occur with the resulting inconvenience with respect to time and effort for repair. If the fracture is repaired by welding as in the case of a metal tree, the integrity of the repair cannot be guaranteed; furthermore, in most cases the weld joint cannot be made completely smooth which causes excessive wear to the leather portion of the saddle. With respect to a wooden tree it is not repairable and therefore must be discarded.

Another shortcoming of the prior art saddle construction is that the metal tree is fabricated by forging individual parts after which they are welded together to form an integral unit. A problem encountered with this type of construction is that it is difficult to attain perfect symmetry so that even pressure is developed upon the withers of the horse; and, it is well understood in the riding art that lack of tree symmetry and uneven pressure cause back sores and ailments to develop so that a horse won't gallop correctly.

The back symmetry in prior tree design whether in the initial fabrication stage or by uneven spreading of the metal through usage is also undesirable since the saddle will not stay on the horse.

The present invention has alleviated the shortcomings of the prior art saddle design by the use of various compositions for tree manufacture that do not fracture at the stress points due to flexing and bending, and in addition, returns its members to an original passive state without retaining a permanent set. By use of the manufacturing technique and materials employed the tree is produced with perfect symmetry; in addition, the compositions provide a smooth exterior surface in order to eliminate destructive wear upon the leather portion of the saddle.

SUMMARY OF THE INVENTION

The present invention relates to a tree which provides a frame for a riding saddle. The tree is utilized with the leather portion of the saddle to provide a structural support for hanging the girth straps which surround the underbelly of a four legged riding animal and to hold the saddle in place; in addition, the tree provides a means for positioning and holding a stirrup lock from which the stirrups are hung. It is one of the purposes of the tree design of this invention to eliminate the wear factor upon the leather portion of the saddle by providing smooth surfaces and countours. The smoothness of the surfaces and contours eliminates the frictional rubbing between the leather component of the saddle with the tree and is attained by use of certain thermoplastic materials.

The thermoplastics which are employed are materials that are adapted for easy manufacture by injection molding as opposed to the prior art materials such as metal that is forged and welded or wood that must be carved. This technique allows nearly perfect symmetry to be obtained in the configuration of the tree which provides beneficial results to the horse's riding ability. The materials that are used for the tree design provide resiliency and flexibility for the protruding members which is required when positioned upon the withers of, for example, a horse. This inherent flexibility allows the extending members to bend and conform to the configurations created by the flexional movements of the animal's neck and withers. Moreover, this feature allows the tree and its extending members to assume a shape which conforms essentially to the animal's anatomical positioning and repositioning. It is a feature of this invention that irrespective of the amount of flexure of the members they will return to their original symmetrical positioning and will not retain a permanent set.

BRIEF DESCRIPTION OF THE DRAWINGS

FIG. 8 is an isometric view of an exercise tree which utilizes a cut-back area with respect to the elevated pommel.

FIG. 9 is an exercise tree having a depression which is adapted to receive a stirrup lock. DESCRIPTION OF THE PREFERRED EMBODIMENT Reference is made to FIG. 1 of the drawings where the exercise saddle 7 with its centerline 12 is depicted for positioning upon the backbone and withers of a four legged riding animal such as a horse. The saddle 7 has dual layers which may be clearly viewed in FIG. 3 where a top layer 14 is broken away to expose the bottom layer 16; furthermore, the layers 14, 16 may be made of various materials ranging from leather to plastic. Located upon the bottom layer 16 are four pockets where only the pockets 18, 20, 22 are shown for receiving corresponding projections **18*a*, 20*a*, 22*a*of a saddle tree 25 (see FIG. 2). The tree 25 is a support or frame structure and comprises an arched body section or pommel 26 from which extends the two forward projections 18*a*, 20*a* and the two downward projections 22*a*, 24*a*. The tree 25 is fixedly positioned between the two layers 14, 16 to essentially form the saddle 7 of FIG. 1**.

Figure 1:
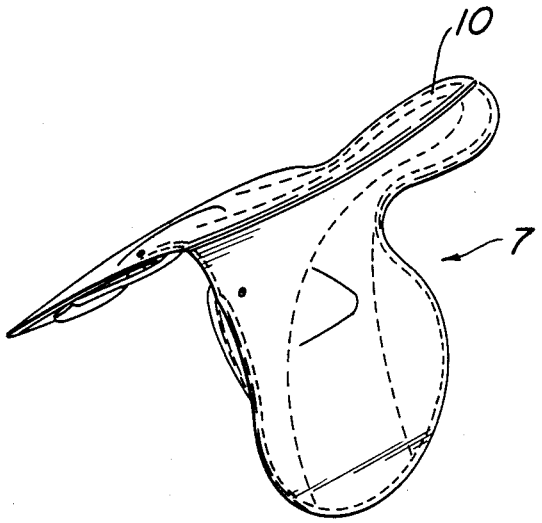
FIG. 1 is an isometric drawing of an exercise saddle.
Figure 2:
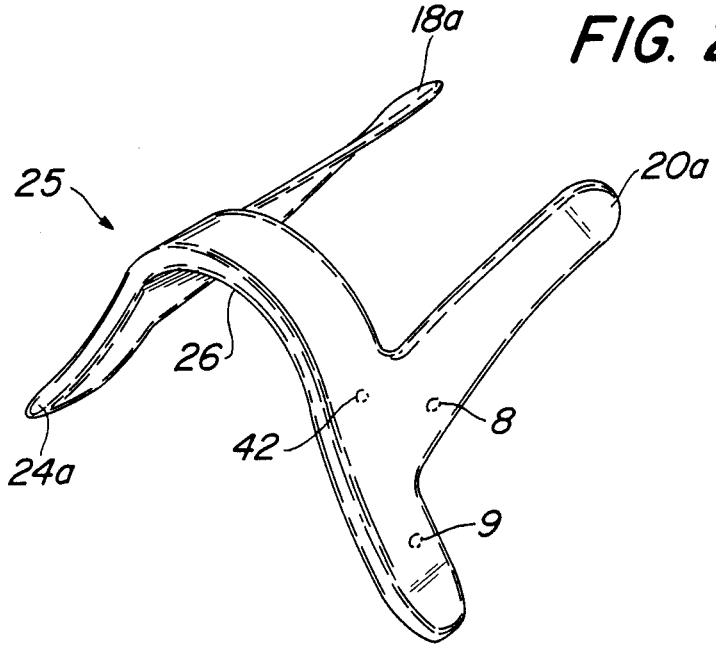
FIG. 2 is an isometric drawing of an exercise tree for use with the saddle of FIG. 1.
Figure 3:
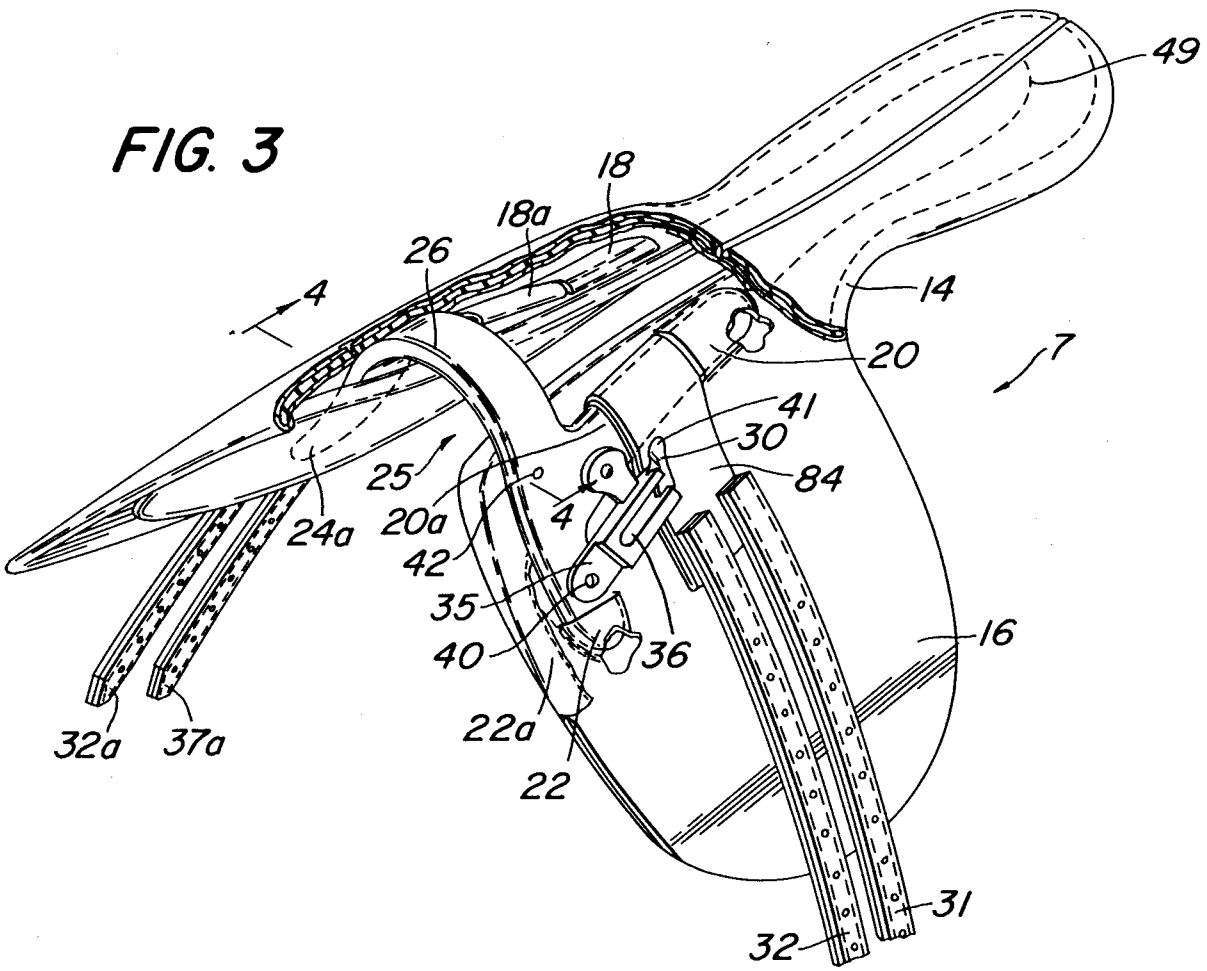
FIG. 3 is isometric drawing which depicts the exercise tree positioned within the saddle, and in addition, illustrates a positioning of a stirrup lock girth straps upon the tree.
Figure 4:
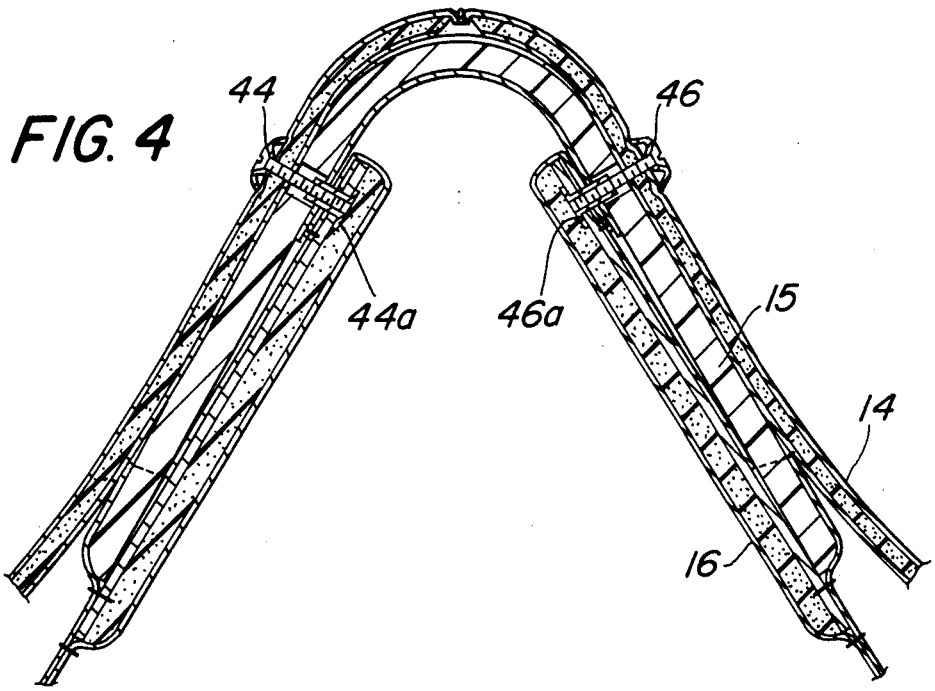
FIG. 4 is a sectional view taken along the line 4—4 of FIG. 3.

The tree 25 of FIGS. 2, 3 forms a frame member for hanging girth straps or billets 31, 32 which are joined to a single strap 34 for attachment to the tree's forward projection **20*a*. It is understood that girth straps 31*a*, 32*a* are similarly attached to the forward projection 18*a*. The girth straps are part of the saddle 7 are girded under the horse's belly for holding the saddle firmly in place. In addition, the tree constitutes a support member for positioning and holding a stirrup lock 35 by means of dual fasteners 40, 41 which are threaded through holes located by means of dimples 8, 9 (see FIG. 2). The stirrup lock 35 provides an upwardly oriented slot 36 for receiving stirrup straps (not shown); as understood, the stirrup lock 35 provides a safety release 30 at the open end of the slot for preventing stirrup straps from slipping out. When the top layer 14 is in position to completely cover the bottom layer 16 it is held in place by stitching the two layers together as, for example, by stitches 49. The two layers 14, 16 are also joined to the tree 25 by means of a fastener positioned through a hole located by a dimple 42 as may be clearly seen by referring to the FIGS. 2, and 3. The sectional view of FIG. 4 illustrates the manner in which the top and bottom layers 14, 16 are arranged with respect to the tree 25 and formed into an integral unit. The integration of the tree 25 with the layers 14, 16 is achieved by fastening each layer to the tree via a threaded bolt arrangement. By this means a threaded female receptacle 46*a* is positioned within the lower layer 16 and fork 25 for receiving the bolt 46 which is located through a hole provided in the top layer 14. Another manner of fastening the three units 14, 16, 25** to another will be discussed hereinbelow.

Durability is necessary in the three member 25 in order to prevent a fracture from ocurring between the projection **18*a*, 20*a*, 22*a*, 24*a* and the pommel 26 (see FIG. 3) which may cause the saddle 7 to move away from the horse's withers; such an event has potential danger since it may cause the rider to be thrown with its concomitant results. In order to provide the tree 25 the above-mentioned charactertistic certain thermoplastic materials are employed in its fabrication which are suitable for use in an injection molding process. The preferred thermoplastic for molding is polypropylene combined with 5–15% fiberglass. Polypropylene is a particularly suitable thermosplastic resin for the fabrication of the tree 25 since in addition to its durability it also has a memory characteristic that enables to projection 18*a*, 20*a*, and 24*a* to be flexed during a riding exercise after which it returns to its original form. The addition of the fiberglass to the polypropylene enhances its durability. The polypropylene is also a desirable resin material for fabricating the tree 25 since it readily accommodates an acceptance of a sharply pointed tack. This is significant since it enables the tree 25 to be made integral with the two saddle layers by the simple expedient of driving a tack through the top layer 14 and into the tree, and from the underside by driving a second tack through the tree to secure the layer 16**.

Other preferred thermoplastics which are suitable for forming the tree 25 by molding with 5–15% fiberglass are nylon, polycarbonate and polyacrylate; furthermore, polypropylene, nylon, polycarbonate and polyacrylate may be fabricated without the addition of fiberglass with minimal disminution of the durability characteristic. The tree 25 is formed by an injection molding process which is suitable for fabricating fiberglass reinforced thermoplastic parts. The resins of polypropylene, nylon, polycarbonate and polyacrylate which are combined with or without the above stated percentage of fiberglass are supplied in pellet form and after suitable drying are melted in a plastifying cylinder. The resins are melted in the melting cylinder at the following temperatures: polypropylene in a range of 380°–420° F.; nylon in a range of 580°–620° F.; polycarbonate in a range 550°–600° F. and polyarylate in a range of 600°–660 F. The molten thermoplastic resin is next sent into a cool mold under an injection pressure of between 5,000–15,000 psi.. The mold is then allowed to cool for several minutes after which the tree 25 is ejected upon opening the mold.

The forming of the tree 25 in one piece by injection molding is advantageous due to the smooth surfaces that are produced. This is in opposition to the relatively rough surfaces that are produced by the prior manucfacturing method of forging and welding when using metal for the tree fabrication. With respect to the carved wooden tree, its surfaces are also somewhat rough its manufacture is labor intensive; hence, is not economically viable in a competitive environment. A smooth exterior surface produces minimal friction wear between the top and bottom layer 14, 16 and therefore enhances the saddle's longevity. In addition, the tree 25 of the invention is fabricated with perfect symmetry which was not always achievable with the metal or wood tree. Therefore, the symmetrical tree 25 is safer for the rider and more comfortable for the horse since it does not produce uneven pressure on its back and does not produce back sores. Furthermore, the horse is not as vulnerable to back ailments with a perfectly symmetrical tree and therefore it tends to gallop in a correct manner.

Figure 5:
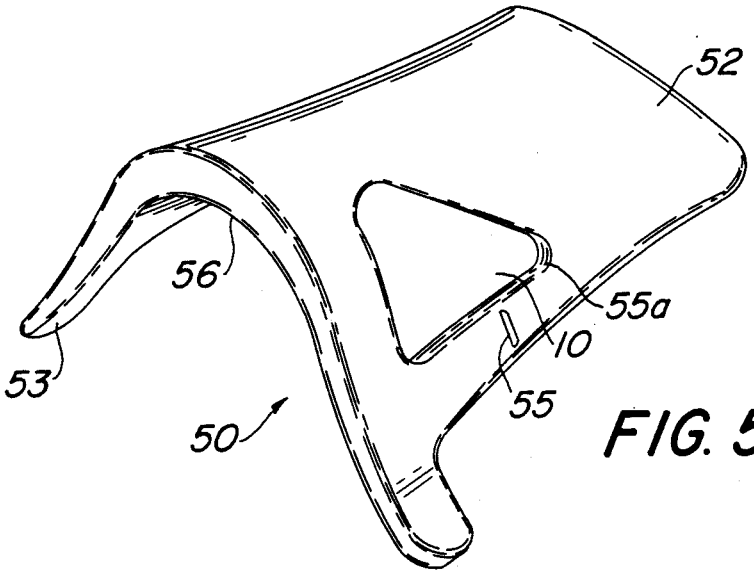
FIG. 5 is a tree configuration for use with a racing saddle.
Figure 6:
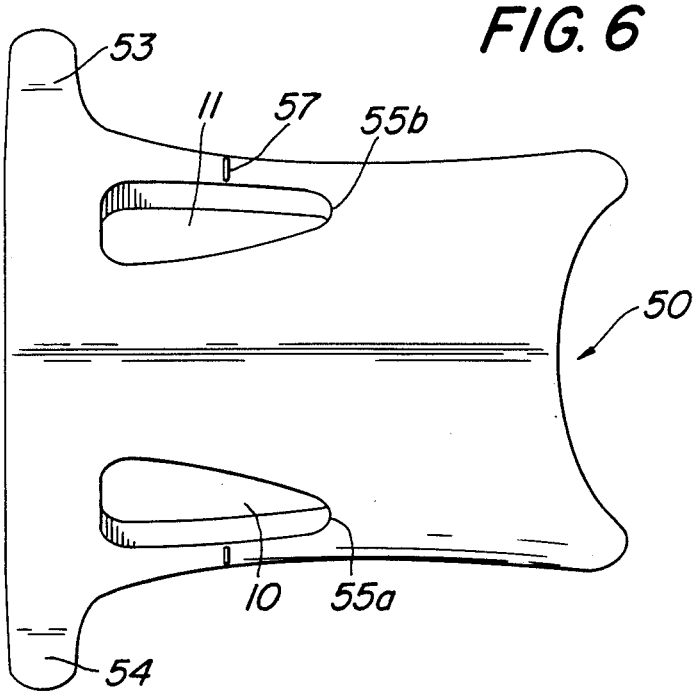
FIG. 6 is a top view of the racing tree of FIG. 5 together with marks for alingning stirrups and/or fabric.
Figure 7:
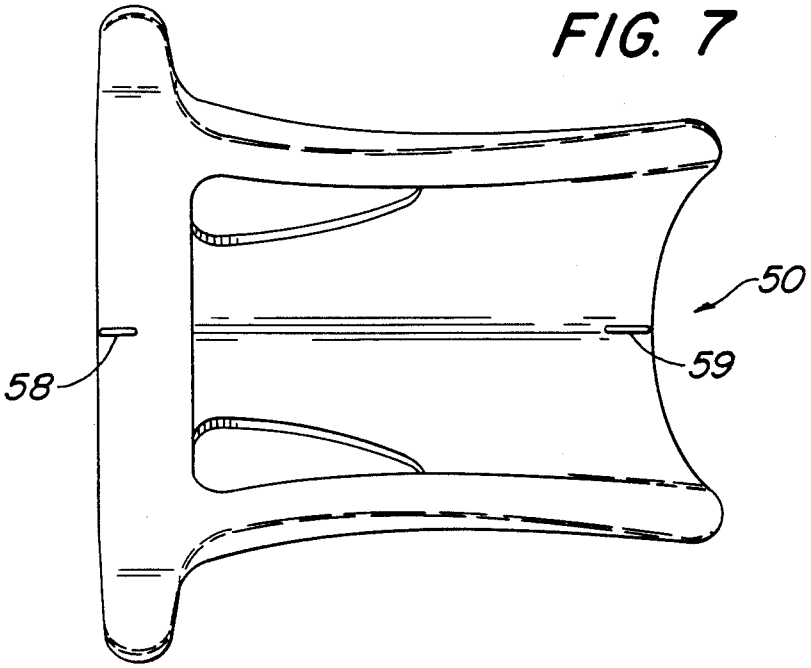
FIG. 7 is a bottom view of the racing tree of FIG. 5 and 6 together with alignment marks.

Referring to FIG. 5 there is depicted a front view of a tree 50 for use in smaller racing saddles (not shown). The racing tree provides a single rearwardly facing projection 52 and two downward projections 53, 54. Even though the tree 50 is smaller in measurement than the exercise tree 25 of FIG. 2, 3 it is nevertheless utilized in a saddle as a frame or support in the same manner as previously described. However, triangular openings 10, 11 (see FIG. 6) are provided on each side for permitting an attachment of a webbing (not shown) which is located to the right of the demarcation lines 55 and 57. In actuality, the webbing has a width wherein one of its edges is located at the line 55, 57 and extends to an adjacent curved end **55*a*, 55*b*. The webbing is positioned upon the tree 50 in a manner that provides two downward projections 53, 54. The webbing's strength is also enhanced by draping over the pommel 56 where it is also attached to a leg of the triangular opening 11 in the manner previously described. The downward webbing projection is employed to permit the horse's girth straps to be sewn thereto. Stirrup straps (not shown) to which stirrups are connected are attached to the tree 50 via the triangular opening 10 by a single buckling device which is hung from the left side of the line 55. It is therefore readily apparent that the demarcation lines 55, 57 are designed for proper alignment of the stirrups as well as for the fabric from which the girth straps are made. This is of great benefit in the manufacture of the racing saddle (not shown) during its various stages. FIG. 7 which depicts the bottom view of the tree 50 of FIG. 5, 6 also illustrates alignment marks 58, 59. The marks 58, 59 are also important in the manufacturing stages since it enables the maker to position the tree 50 so that it is perfectly centered with respect to the padding and leather (not shown) with which it is combined. It is readily understood that if the tree 50 is not inproper alignment with the padding and leather the saddle will not be fitted to the horse in a manner that enhances the rider's safety. The demarcation lines 55, 57** are deemed significant to the manufacturing process that they are molded into the thermoplastic material forming the tree.

Referring to FIG. 8 there is shown a tree 60 for use in an exercise saddle but which incorporates a cut-back 62 in the pommel area. The cut-back 62 is incorporated in the tree 60 to provide a comfortable fit with the horse's withers which is the highest point at the base of its neck. The cut-back 62 accommodates variations in the wither's dimension such that any irritation caused by rubbing is eliminated. In FIG. 9 the cut-back tree 60 includes a depression 63 which is formed and shaped to receive the stirrups lock 65. As undestood by those skilled in the art, the stirrup lock 65 is held in position by the use of two fasteners which are positioned through holes located by the dimples 8, 9 of FIG. 2. The depression 63 is provided to avoid cutting the leather of the top layer 16 to which it is juxtaposed.

This invention has been described by reference to precise embodiment but it will be appreciated by those skilled in the art this invention is subject to various modifications and to the extent that those modifications would be obvious to one of ordinary skill they are considered as being within the scope of the appended claims.

What is claimed for:

1. An exercise saddle comprising:

(a) a first shaped material having side flaps for positioning upon a race horse in the vicinity of its withers, and said material including a plurality of pockets;

(b) a smooth surfaced tree means having a body portion and four projecting members shaped to conform with said withers, each said member being respectively adapted to fit within one of said pockets and said tree means being made of a thermoplastic composition which permits said members to be formed in a symmetrical configuration and to flex without retaining a permanent set;

(c) a second relatively soft material which substantially conforms to said first shaped material and is juxtaposed to said tree means;

(d) means positioned through said tree and said first and second materials for interconnecting both to form said saddle;

(e) means attached to said tree means for positioning around said horse and for securing said saddle;

(f) a depression formed in said tree means in the vicinity of two said projecting members; and (g) means further attached to said tree means within said depression for connecting stirrups locks; and (h) said smooth surfaced tree means and said attached stirrups locks within said depression preventing said exercise saddle from wearing out prematurely.

2. The saddle in accordance with claim 1 wherein said tree means provides at least spaced dimples which provide guides to locate stirrup locks for joining said stirrup mean.

3. The saddle in accordance with claim 2 wherein said composition comprises a thermoplastic consisting of methacrylic acid combined with 5–15% fiberglass.

4. The saddle in accordance with claim 1 wherein said thermoplastic comprises a plastic material consisting of polypropylene combined with 5–15% fiberglass.

5. The saddle in accordance with claim 1 wherein said thermoplastic comprises polypropylene.

6. The saddle in accordance with claim 1 wherein said thermoplastic comprises methacrylic acid.

7. The saddle in accordance with claim 1 wherein said thermoplastic comprises an ethylene copolymer combined with 5–15% fiberglass.

8. The saddle in accordance with claim 1 wherein said thermoplastic comprises an ethylene copolymer.

9. The saddle in accordance with claim 1 wherein said thermoplastic comprises nylon combined with 5–15% fiberglass.

10. The saddle in accordance with claim 1 wherein said thermoplastic comprises nylon.

11. The saddle in accordance with claim 1 wherein said thermoplastic comprises a polyacrylate combined with 5–15% fiberglass.

12. The saddle in accordance with claim 1 wherein said thermoplastic comprises polyacrylate.

13. The saddle in accordance with claim 1 wherein said thermoplastic comprises polycarbonate combined with 5–15% fiberglass.

14. The saddle in accordance with claim 1 wherein said thermoplastic comprises polycarbonate.

15. The saddle in accordance with claim 1 wherein said tree means is formed with two forward projections and two downward projections extending from a main body portion.

16. An exercise saddle comprising:

(a) a first shaped material having side flaps for positioning upon a race horse in the vicinity of its withers, and said material invluding a plurality of pockets;

(b) a smooth sufaced tree means having a body portion and four projecting members shaped to comform with said withers, each said member being respectively adapted to fit within one of said pockets;

(c) two of said projecting members extending backwardly and the remaining two members extending downwardly;

(d) said tree means being made of a thermoplastic composition which permits said members to be formed in a symmetrical configuration and to flex without retaining a permanent set;

(e) a second and relatively soft material which substantially conforms to said first shaped material for positioning over said tree means;

(f) means positioned through said tree said first and second materials for interconnecting both to form said saddle;

(g) means attached to said tree means for positioning around said horse and for securing said saddle;

(h) a depression formed in said tree means in the vicinity of said two downwardly projecting members;

(i) means further attached to said tree means within said depression for connecting stirrup locks; and (k) said smooth surfaced tree means and said attached stirrup locks within said depression preventing said exercise saddle from wearing out prematurely.

* * * * *